US005228274A

United States Patent [19]

De Man et al.

[11] Patent Number: 5,228,274

[45] Date of Patent: Jul. 20, 1993

[54] SEALING APPARATUS FOR METAL LID CANNING JARS

[75] Inventors: Heiko T. De Man, Danville; Robert E. Warden, San Francisco, both of Calif.

[73] Assignee: Decosonic, Inc., St.Laurent, Canada

[21] Appl. No.: 824,260

[22] Filed: Jan. 21, 1992

[51] Int. Cl.[5] ..... B67B 3/24; B67B 31/04; B67B 7/28

[52] U.S. Cl. ..... 53/510; 53/88; 53/98; 53/367; 426/404

[58] Field of Search ..... 53/88, 101, 98, 103, 53/105, 510, 367; 426/404

[56] References Cited

U.S. PATENT DOCUMENTS

| | | | |
|---|---|---|---|
| 789,502 | 5/1905 | Honiss et al. | 53/98 |
| 1,005,349 | 10/1911 | Staunton | 53/103 X |
| 1,521,203 | 12/1924 | Roehrig | 53/98 X |
| 1,630,215 | 5/1927 | Poole | 53/98 X |
| 3,169,355 | 2/1965 | Hollaway et al. . | |
| 4,372,096 | 2/1983 | Baum | 53/103 X |
| 4,640,426 | 2/1987 | Wasley | 53/88 X |
| 4,660,355 | 4/1987 | Kristen | 53/88 X |
| 4,763,802 | 8/1988 | Johnston | 53/88 X |

*Primary Examiner*—Horace M. Culver
*Attorney, Agent, or Firm*—Townsend and Townsend

[57] ABSTRACT

An improved generally concave body (bell attachment) is disclosed for applying a vacuum to conventional canning jars. Like the prior art, the bell attachment fits over the jar top and a placed flexible lid for sealing the jar and seals to the top of the jar at the jar sealing rim. Unlike the prior art, the top locates with respect to the thread on the jar to limit the penetration of the top of the bell over the top of the jar and to define clearance between the bell and lid. This clearance sets forth a small distance of vertical excursion between the captured flexible lid and the top of the bell. Preferably, a system of peripheral and overhead grooves are provided in the interior of the bell so that the flexible top may be guided into sealing registry with the jar top while still maintaining a free passage for the evacuation of gas interior of the jar to an evacuating connection communicated to the bell. A small spring force may be used to bias the lid onto the top of the jar such as a sponge or spring washer. When vacuum is drawn on the bell installed and sealed at the sealing ring to the flexible lid closed jar top, vacuum begins to form at once within the jar. Preferably, the bell is designed to define a minimal volume with respect to the jar top and flexible lid so that vacuum can be drawn on as small a volume as possible. An improved vacuum drawn on the flexible lid sealed jar results.

4 Claims, 4 Drawing Sheets

SEALING APPARATUS FOR METAL LID CANNING JARS

This invention relates to canning jars of the glass variety such as jars sold under the registered trademarks Mason®, Kerr®, and Ball®. More particularly, a device is disclosed for taking a jar sealed with a metallic lid and applying a vacuum to the interior of the jar.

BACKGROUND OF THE INVENTION

It is known to apply a vacuum to glass canning jars. Such jars are sold under the registered trademarks Mason®, Kerr®, and Ball®. For the purpose of this invention, these jars may be described both in construction and operation.

As constructed, these jars have a lower seal rim defined below their open top. It is known in the prior art that this lower rim may be a location of a vacuum seal for drawing a vacuum typically when the jar is filled with food contents to be preserved.

These jars have an open cylindrical top protruding above the seal rim. The top of the jar terminates at an upper sealing surface at the top of the cylindrical top. The cylindrical surface is threaded on the exterior surface with a male thread conformed to standard dimension shared by all jar brands.

When the jar is originally sealed, a flexible lid, typically of metal, is placed over the top of the jar. This flexible lid has a peripheral female flange with a contained rubber gasket. When the jar is initially sealed, the flexible lid at the rubber gasket is place over the top of the jar. Presuming that the flexible lid is in place, when a vacuum is drawn to the interior of the jar, the lid seals at the gasket to the seal surface at the cylindrical top of the jar and remains in place. After a vacuum is established in the interior of the jar, a threaded top compressing the periphery of the metallic lid rim to the top of the jar is threaded over the jar at the thread. As a result, the flexible lid is held firmly in place and the vacuum original obtained in the interior of the jar preserved.

In a normal hot canning operation, the jar is filled with the contents to be preserved and the flexible lid is placed over the top of the can. The lid sealed jars are then heated until substantially the entire volume between the jar contents and the sealing lid is filled with water vapor. Thereafter, the jars are cooled. The water vapor filling the volume under the lid condenses and a "vacuum" is drawn on the contents of the jar. To assure maintenance of the vacuum drawn within the jar, a threaded top having a compressing inner extending annulus is threaded to the jar and utilized to compress the flexible lid at the peripheral gasket to the jar top at the upwardly exposed sealing surface.

It is sometimes desirable to draw a vacuum without the heating step described above. In the prior art, a flexible sealing lid was placed over the jar and its contents. A generally concave body with a vacuum attachment (hereafter referred to as a "bell") was fitted over the top of the jar sealed by the flexible lid. A seal was effected between the sealing rim and the sides of the bell by a gasket. The bell was spaced from the sealing lid by three pressure points, these points being spaced at 120° intervals around the side of the lid bearing directly on the lid at the sealing rubber gasket of the lid. Vacuum was drawn interior of the bell. The lid flexed or bent upwardly between the pressure points from the bell on the lid responsive the to pressure interior of the jar and the lack of pressure in the bell. A vacuum was drawn on the interior of the jar.

DISCOVERY

We have determined that the force necessary for bending or flexing the lid upwardly with between the pressure points under the differential forces provided by the vacuum from above the lid and the ambient pressure in the jar from below the lid directly subtracts from the vacuum achievable in the prior art. An example can help in the understanding of the phenomenon.

Assuming that the interior of the jar is under atmospheric pressure, vacuum exceeding 2 pounds per square inch must be drawn on the bell before the lid bends between the pressure points and any vacuum is thereafter drawn on the jar. Further, as the vacuum becomes more complete, the force required to initially bend the lid remains. Assuming that a perfect vacuum is drawn within the bell, at least two pounds per square inch pressure will remain in the jar.

SUMMARY OF THE INVENTION

An improved generally concave body (bell attachment) is disclosed for applying a vacuum to conventional canning jars. Like the prior art, the bell attachment fits over the jar top and a placed flexible lid for sealing the jar and seals to the top of the jar at the jar sealing rim. Unlike the prior art, the top locates with respect to the thread on the jar to limit the penetration of the top of the bell over the top of the jar and to define clearance between the bell and lid. This clearance sets forth a small distance of vertical excursion between the captured flexible lid and the top of the bell. Preferably, a system of peripheral and overhead grooves are provided in the interior of the bell so that the flexible top may be guided into sealing registry with the jar top while still maintaining a free passage for the evacuation of gas interior of the jar to an evacuating connection communicated to the bell. A small spring force may be used to bias the lid onto the top of the jar such as a sponge or spring washer. When vacuum is drawn on the bell installed and sealed at the sealing ring to the flexible lid closed jar top, vacuum begins to form at once within the jar. Preferably, the bell is designed to define a minimal volume with respect to the jar top and flexible lid so that vacuum can be drawn on as small a volume as possible. An improved vacuum drawn on the flexible lid sealed jar results.

DESCRIPTION OF THE PREFERRED EMBODIMENT

Figure 1A:
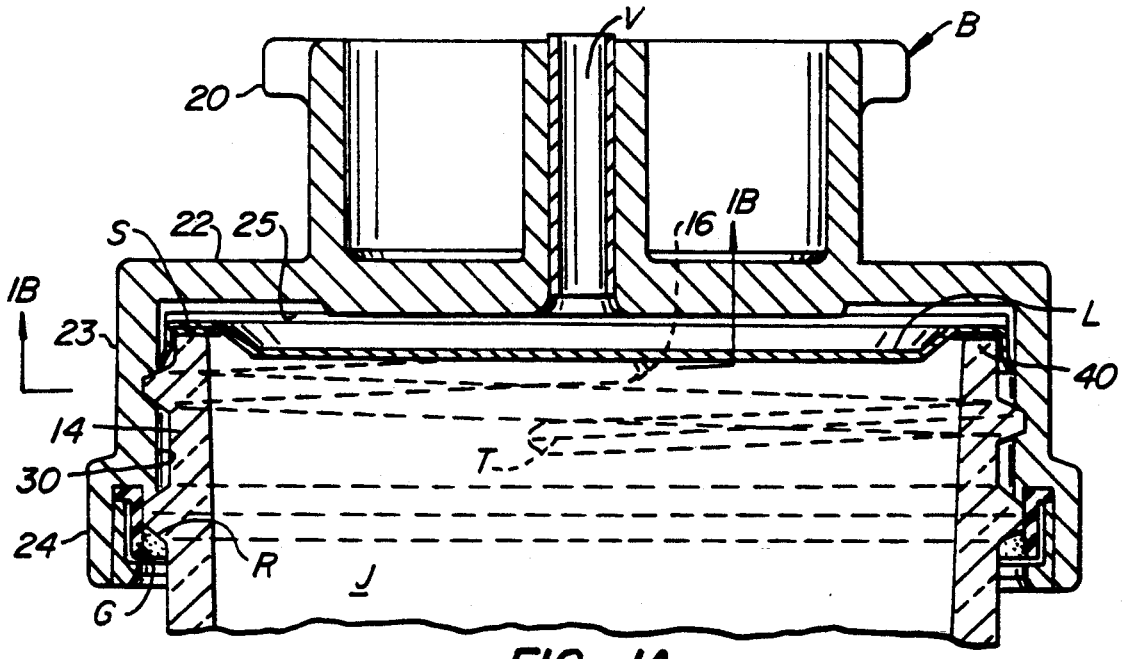
FIG. 1A is a side elevation section of the bell, lid and jar top of this invention illustrating the bell fitting over and sealed to the jar top at the jar sealing rim, the bell capturing the previously placed flexible lid so that a vacuum may be drawn, the view here illustrating the end of the male thread on the jar cooperatively forming a stop with the end of the female thread on the inside of the bell.

Referring to FIG. 1A, jar J with a sealing rim R and upwardly extending cylindrical top 14 is illustrated. Cylindrical top 14 terminates at upwardly exposed jar sealing surface S and is provided with a single thread T on the exterior of the cylindrical top 14. This thread T makes slightly over 360° of revolution on the top and ends at thread end 16 adjacent seal surface S on the top of jar J. The dimensions between thread end 16 and the top of jar J at sealing surface S have proved to be repeatable within close tolerances for jars referred to above. As is conventional in the prior art, flexible lid L has been addressed to sealing surface S at a downward exposed gasket 40. Lid L at gasket 40 has side to side movement in the order of 0.060" without effecting gasket G from making a seal on surface S.

Bell B can be simply understood. It is a generally concave body defined over the top of jar J and includes grasping flange 20. Bell B includes upper surface 22 having a downward depending skirt 23 ending at skirt flare 24 for holding and maintaining gasket G. Centrally of bell B there is defined vacuum aperture V including tube protrusion 30 over which a tube for communicating the vacuum to the bell may be placed (the tube and related apparatus being well known in the prior art are not shown).

Figure 1B:
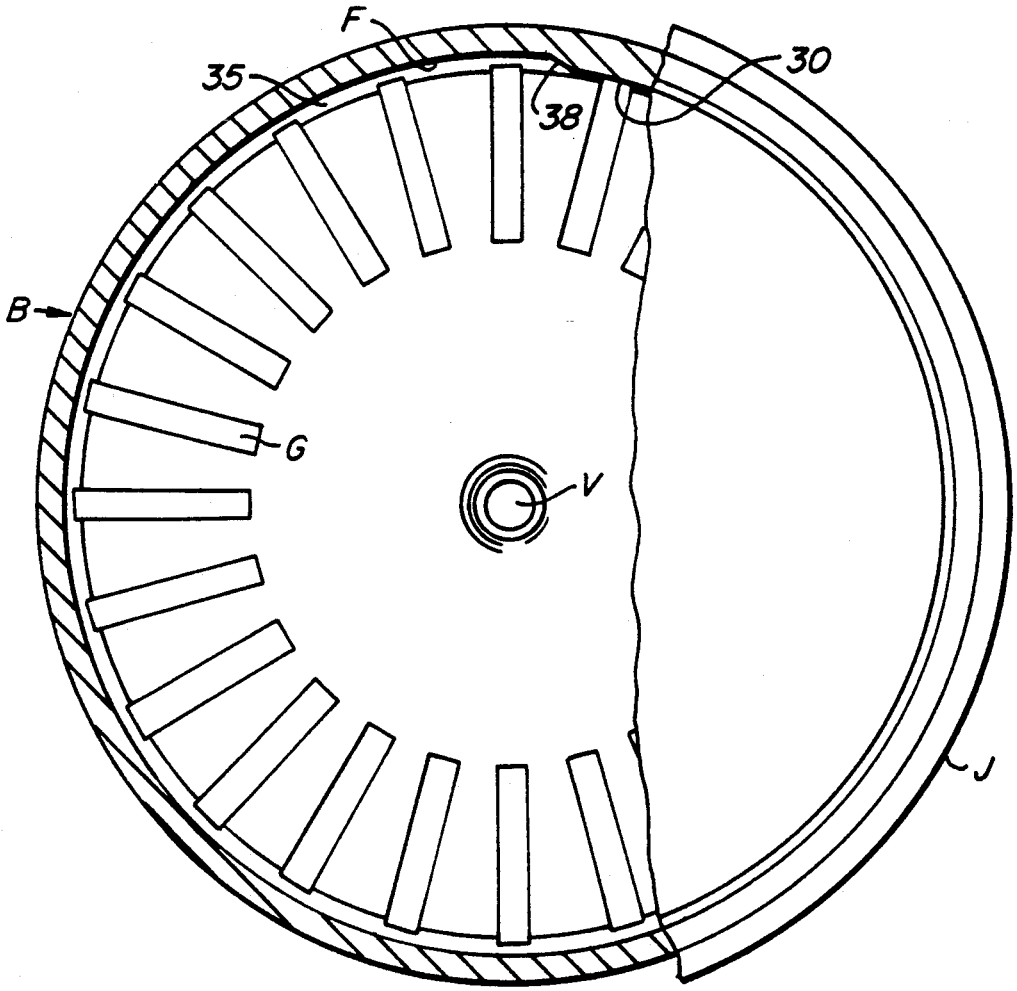
FIG. 1B is a bottom plan of the bell illustrating the formation of grooves for the location of the metallic lid as well as providing defined air passages for facilitating the drawing of a vacuum within the jar.
Figure 3:
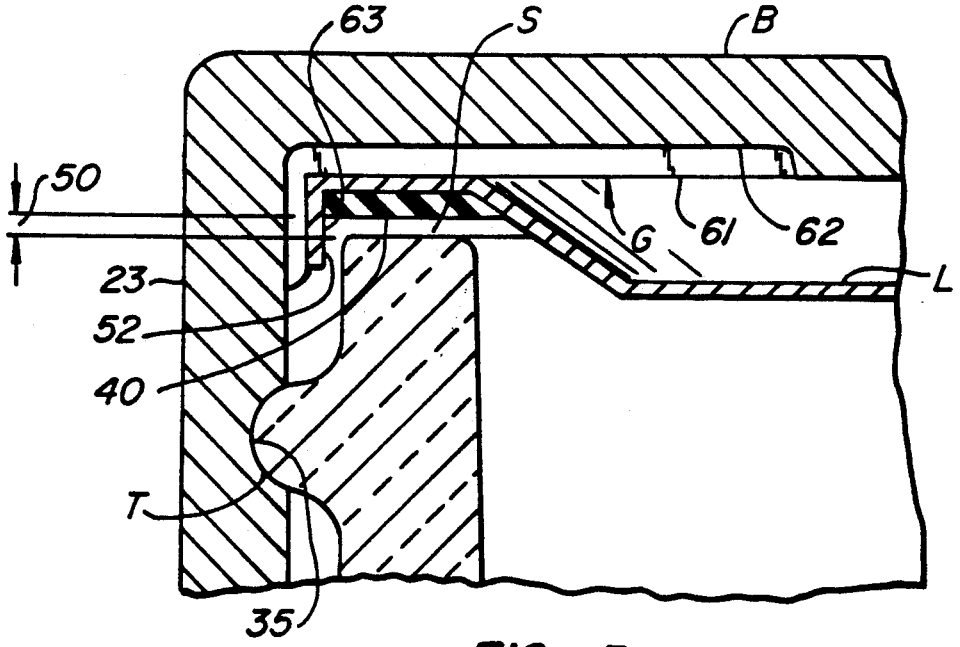
FIG. 3 is a detail in side elevation section of the top of the bell at the upwardly exposed sealing rim of the jar opening showing a small volume defined overlying the metallic lid to enable the lid to be freely lifted by escaping atmosphere from the interior of the jar and illustrating both the air passages defined by the grooves as well as the lid centering function of the grooves.

Referring to FIG. 1B, the interior of the concave bell B is illustrated having grooves G, these grooves G being more understandable when referring to the detail of FIG. 3. Skirt 23 of bell B on inside surface 30 defines female thread 35 which terminates at thread end 36. As will become more apparent hereafter, female thread end 36 on bell B mates with thread T and thread end 16 on jar J to define limited clearance between the bottom of bell B at 25 and lid L.

Referring to FIG. 3, the function of the grooves in centering lid L, limiting the vertical excursion of lid L and enabling aspiration of gas from under lid L can be understood. Grooves G are configured on the underside of bell B. Groves G include radial ridges 61 and radial depressions 62. Radial ridges 61 meet with vertical ridges 63 configured on the inside of bell sides 23.

Movement of bell B downward over the top of jar J is limited by threads T at end 16 on jar J meeting with end 38 of female threads 35. Lid L is given clearance 50 with respect to sealing surface S.

Lid L is centered by ridges 63 in skirt 23 during up and down excursion occasioned by discharge of atmosphere with jar J from under lid L. In such motion, depressions 62 define passages for the free escape of gasses withdrawn from jar J.

Figure 2:
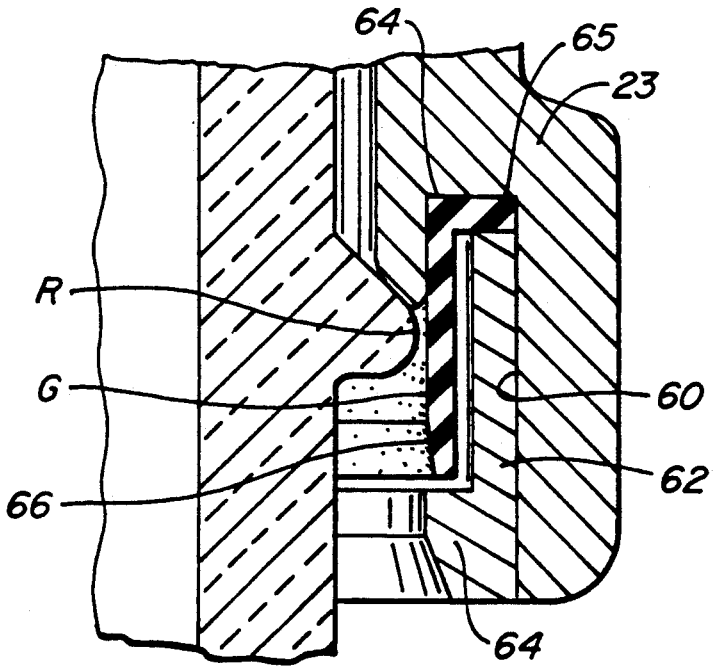
FIG. 2 is a detail in side elevation section of at the bottom of the bell at the edge of the jar sealing rim illustrating the placement of a sealing gasket to the bell periphery so that atmospheric pressure from the exterior of the bell assists in sealing vacuum interior of the bell when the vacuum is drawn.

Referring to FIG. 2, skirt 23 includes annulus 60 containing rim 62 having a lower rim annulus 64. Rim 62 captures gasket G at upper annulus 64 while gasket G depends downward at gasket skirt 66 over sealing rim R of jar J.

In operation, lower rim annulus 64 centers jar J at rim R so that skirt 66 abuts sealing rim R. When a vacuum is drawn interior of bell B, skirt 66 is pulled against rim R effecting a seal of bell B with respect to the top of jar J.

Figure 4:
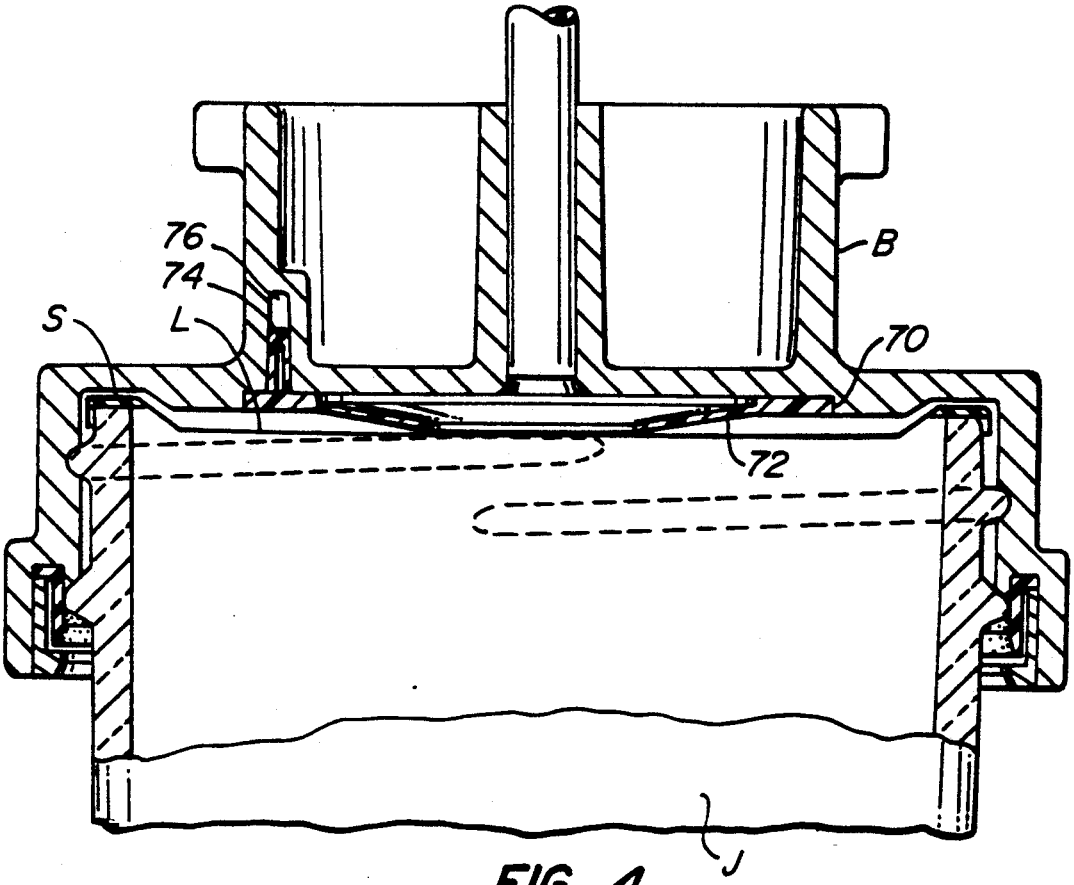
FIG. 4 is a side elevation of a jar, sealing metallic lid, and vacuum drawing bell illustrating the downward bias of the metallic lid onto the jar by a Nylon® or Delrin® washer.

Referring to FIG. 4, it is desirable to provide for a small bias of lid L with respect to sealing surface S on jar J. Accordingly, a conical Delrin® or Nylon® washer 72 is fitted to both annulus 72 and at holding pin 74 to aperture 76 in bell B.

Figure 5:
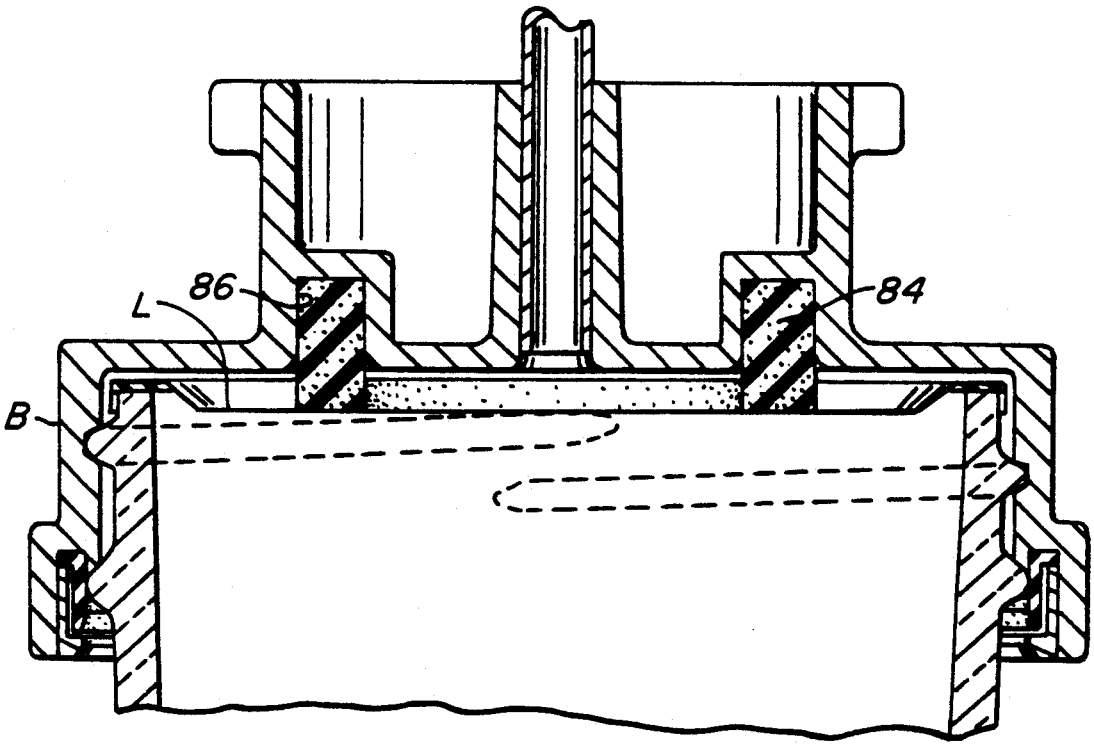
FIG. 5 is a side elevation similar to FIG. 4 illustrating the downward bias of the metallic lid onto the jar by sponge material; and, FIG. 6 is a detail of an alternate embodiment illustrating the lid and sealing gasket with one side of the section taken at the lid illustrating the gasket in an unsealed disposition and the remaining side of the gasket at the seal illustrating the gasket in a sealed disposition.

Alternately, as illustrated in FIG. 5, porous rubber ring 84 may fit in female annulus 86 for applying bias to lid L. In either case, lid L will be biased downward to assure that a seal is formed.

Figure 6:
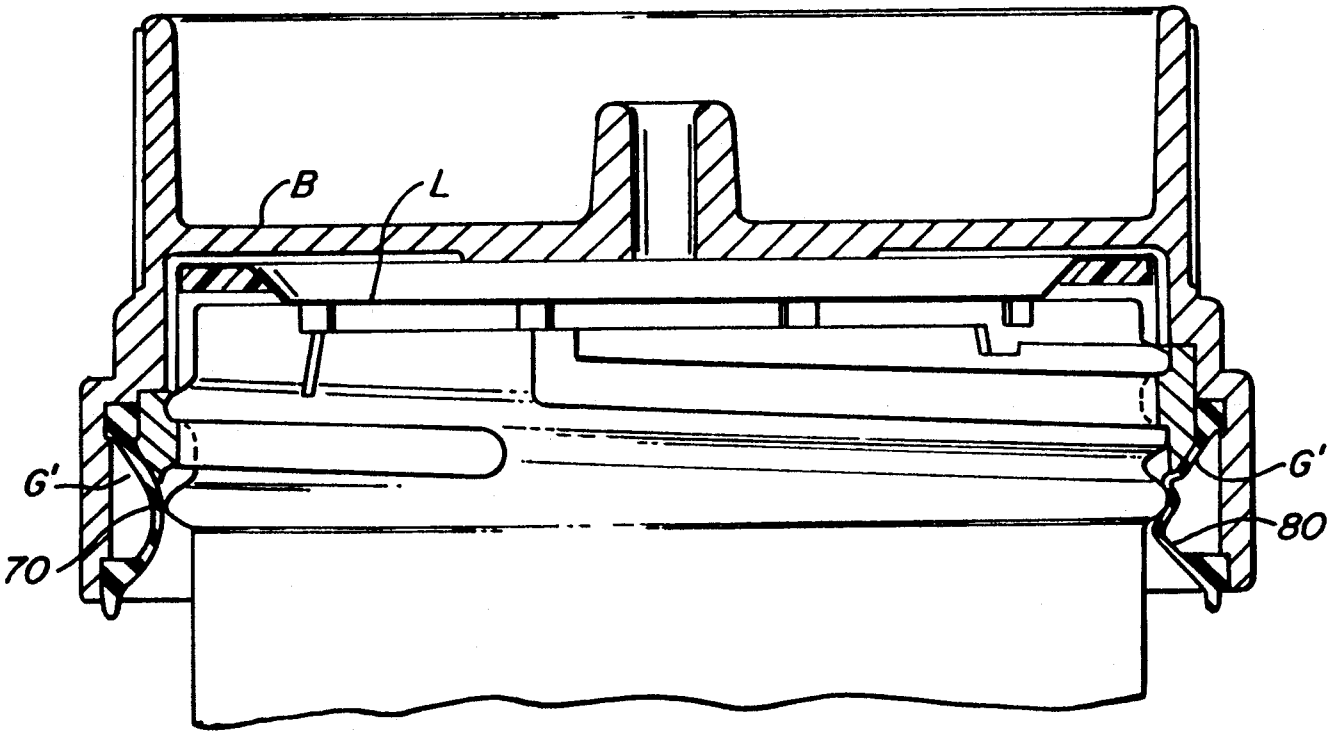

Referring to FIG. 6, an alternate form of seal is disclosed. A tire like gasket G' is disposed at the side of bell B. When no vacuum is drawn, gasket G' adopts a regular arcuate configuration 70. This is shown in the left hand segment of the drawing. When vacuum is drawn, gasket G' adopts a conforming configuration around threads T. This is shown in the right hand segment of the drawing. This embodiment has the advantage of conforming to threads T at any particular elevation.

The reader will understand that the underside of bell B with respect to jar J and lid L is given as small a volume as practicable so that a vacuum may be efficiently drawn.

What is claimed is:

1. A vacuum adapter for evacuating a canning jar of the type having a sealing rim, a cylindrical top protruding upwardly from said sealing rim terminating at an upwardly exposed sealing surface, and a thread defined on the exterior of said top between said sealing rim and said upwardly exposed sealing surface, and a lid for engagement to said sealing surface of said jar, said vacuum adapter comprising:

a bell including a generally concave body portion defining an interior cavity with a depending skirt, the inside dimension of said skirt slightly exceeding the outside dimension of said jar at said opening;

means for sealing said generally concave body portion to said seal rim at the bottom portion of said skirt, means for establishing clearance for movement of said seal lid between said bell at the interior of said concave body portion and seal surface on said jar whereby said lid can move relative to said bell at said concave body portion when vacuum is drawn on said lid;

a vacuum conduit connection to said concave body portion for establishing a vacuum within said bell whereby said lid can unseat to permit the escape of gas interior of said jar and reseat to maintain vacuum with in said jar;

grooves defining radially disposed ridges with intervening depressions, said grooves commencing on the underside of said concave body overlying said lid and extending to and downward of the inside surface of said skirt;

said depressions defining air flow passages around said lid to define an evacuation path for gas escaping from said jar under said lid; and, said radially disposed ridges at said grooves causing centering of said lid with respect to said seal top whereby said lid reseats to said sealing top when gas is evacuated from the interior of said jar.

2. The invention of claim 1 wherein said means for establishing clearance for movement of said seal lid includes;

female threads defined interior of said concave body of said bell, said threads ending to cause registry of the end of said female threads on the interior of the concave body of said bell with the corresponding ends of male threads on the opening of said jar.

3. The invention of claim 1 and wherein said means for sealing said bell to said sealing rim on said jar includes, means communicated to the interior volume of said concave body portion at one portion and communicated to atmosphere exterior of said concave body portion at said other portion to force said seal onto said rim when a vacuum is drawn interior of the bell.

4. The invention of claim 1 and wherein said means for sealing said bell to said sealing rim includes, a gasket having an arcuate configuration and first and second respective upper and lower attachments at the inside of said bell.

* * * * *